United States Patent [19]

Skelley

[11] Patent Number: 4,502,426

[45] Date of Patent: Mar. 5, 1985

[54] VARIABLE VALVE LIFT AND TIMING MECHANISM

[76] Inventor: James H. Skelley, 1574 Cole, Birmingham, Mich. 48008

[21] Appl. No.: 605,876

[22] Filed: May 1, 1984

Related U.S. Application Data

[63] Continuation of Ser. No. 378,892, May 17, 1982, abandoned.

[51] Int. Cl.[3] ..... F01L 1/34

[52] U.S. Cl. ..... 123/90.15; 123/90.16; 123/90.27

[58] Field of Search ..... 123/90.15, 90.16, 90.17, 123/90.27, 90.48, 90.39, 345, 346, 347, 348

[56] References Cited

U.S. PATENT DOCUMENTS

| | | | |
|---|---|---|---|
| 1,220,530 | 3/1917 | Neal | 123/90.16 |
| 2,260,983 | 10/1941 | Walker | 123/90.16 |
| 2,289,201 | 7/1942 | Martin | 123/90.48 |
| 2,410,411 | 11/1946 | Gregory | 123/90.16 |
| 2,565,022 | 8/1951 | Hattink | 123/90.16 |
| 3,166,058 | 1/1965 | Zink | 123/90.27 |
| 3,911,879 | 10/1975 | Altmann | 123/90.27 |
| 4,205,634 | 6/1980 | Tourtelot | 123/90.17 |
| 4,261,307 | 4/1981 | Oidberg | 123/90.17 |
| 4,382,428 | 5/1983 | Tourtelot | 123/90.16 |

FOREIGN PATENT DOCUMENTS

| | | | |
|---|---|---|---|
| 2068495 | 8/1981 | United Kingdom | 123/90.16 |

*Primary Examiner*—Ira S. Lazarus
*Assistant Examiner*—R. S. Bailey
*Attorney, Agent, or Firm*—Barnes, Kisselle, Raisch, Choate, Whittemore & Hulbert

[57] ABSTRACT

A variable valve lift and timing mechanism for an internal combustion engine, including a non-circular secondary cam having a head, with first and second convexly curved surfaces, at a free end thereof operably interposed between and slidably contacting a fixed profile primary cam and an associated valve lifter. The secondary cam is supported at the other end for pivotal movement about a fulcrum point spaced from its head. A control unit varies the position of the fulcrum point as a function of the speed of the engine to thereby vary the amount of lift and the timing of the opening and closing of said valve. The secondary cam is supported on a pivot shaft having a bracket carried on the engine cam for movement of the pivot shaft in and arc concentric with the axis of said cam shaft. The secondary cam head is non-circular and has first and second convexly curved surfaces slidably bearing against the primary cam and lifter respectively. The control unit comprises a hydraulic cylinder housing an actuating piston mechanically linked to the pivot shaft for controlling the movement of the same. The working chamber of the cylinder communicates with a source of engine lubrication pressurized oil having an output pressure correlated with engine speed whereby valve timing is advanced and valve lift increased with an increase in engine speed and vice versa. Other features include mid-speed positioning of the secondary cam by two-stage biasing springs, a pressure-regulating by-pass valve providing linearity in pressure change with engine speed change, and pressure transient and pulsation dampening.

18 Claims, 11 Drawing Figures

VARIABLE VALVE LIFT AND TIMING MECHANISM

This is a continuation of application Ser. No. 06/378,892, filed May 17, 1982, now abandoned.

This invention relates generally to a mechanism for automatically actuating the valve or valves of an internal combustion engine, and more particularly relates to a mechanism for varying the lift and timing of one or more of the intake valves in an internal combustion engine in order to obtain optimum operational and design efficiency of the engine throughout its operating speed and load range.

It has been a long recognized problem in the art of automotive internal combustion engines, wherein operation is required under widely varying speed and load conditions, that fixed timing and lift of the intake and/or exhaust valves represents a compromise which does not provide optimum efficiency and performance throughout the range of operating speeds and loads. Accordingly, many approaches to this problem have been provided over the past seventy years or so, among which are those typified by the variable valve timing mechanism shown in U.S. Pat. No. 4,205,634 and in the prior art patents cited herein. Other approaches to the problem are typified by U.S. Pat. Nos. 2,260,983 and 4,249,488. The present invention has among its several objects the improvement of the art of automatic variable valve lift and timing mechanisms to achieve the recognized advantages of enhanced engine performance and design efficiency over fixed timing arrangements, and to achieve this in a more economical, versatile and reliable manner.

Other objects, features and advantages of the present invention will become apparent from the following detailed description taken in conjunction with the accompanying drawings wherein.

Figure 3:
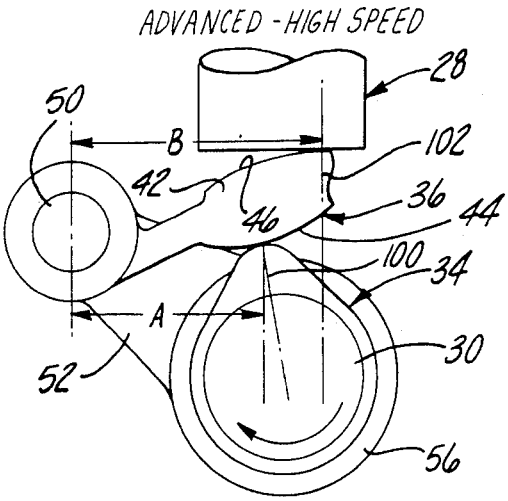
FIGS. 3 and 4 are fragmentary simplified views of the primary cam, secondary cam and valve lifter of FIG. 1 (inverted therefrom), shown respectively at maximum and minimum valve lift, in the fully advanced, high speed mode.
Figure 5:
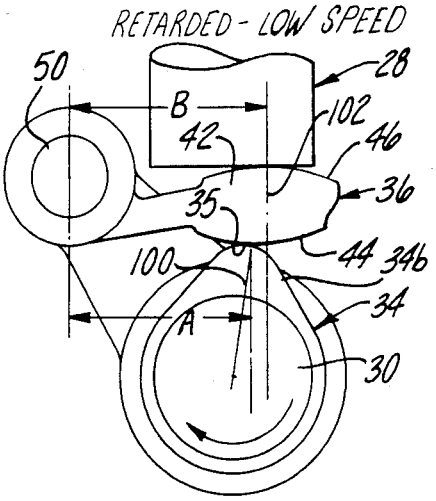
Figure 4:
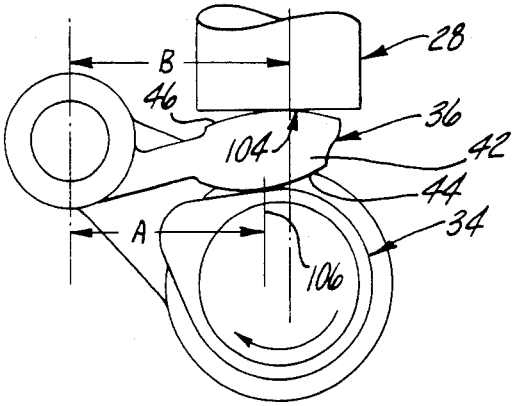
Figure 6:
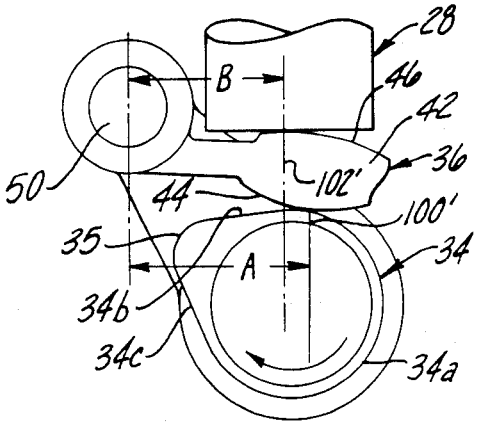

FIGS. 5 and 6 are also simplified fragmentary views, similar to FIGS. 3 and 4, illustrating the primary cam, secondary cam and valve lifter in the fully retarded, low speed mode. FIGS. 3 and 5 are shown at a fully open condition while FIGS. 4 and 6 are shown at the fully closed condition.

Figure 7:
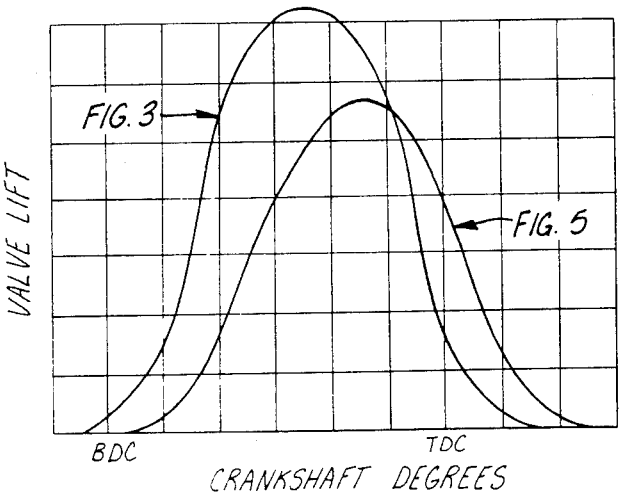

FIG. 7 is a graph of valve lift and time of valve opening and closing versus crankshaft angle achieved for both the low engine speed and high engine speed modes.

Figure 8:
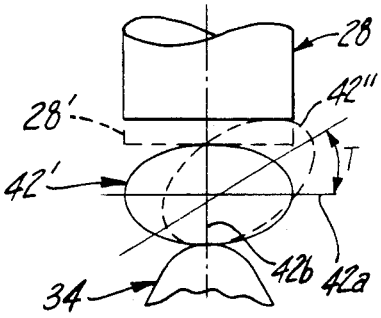

FIG. 8 is a fragmentary diagrammatic view illustrating how the secondary cam may be modified pursuant to a design feature of the invention.

Figure 9:
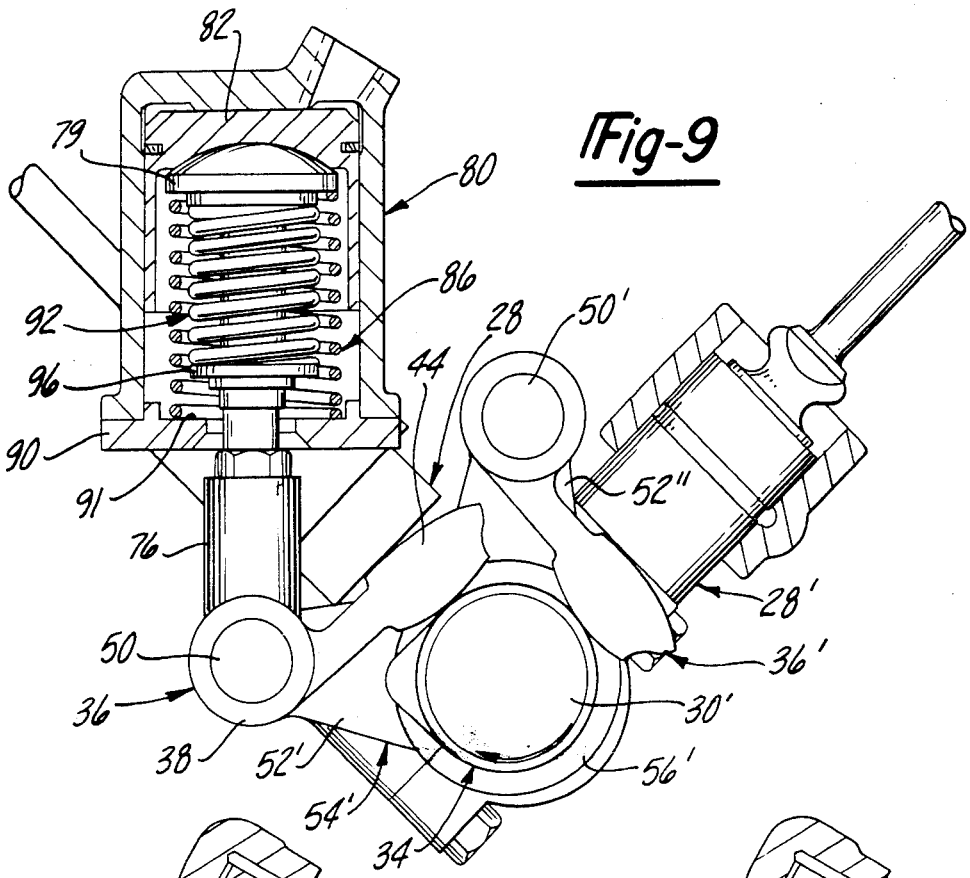

FIG. 9 is a fragmentary view of the application of the valve actuating mechanism of the invention to a V-type engine, with the control piston shown in engine low speed position.

Figure 10:
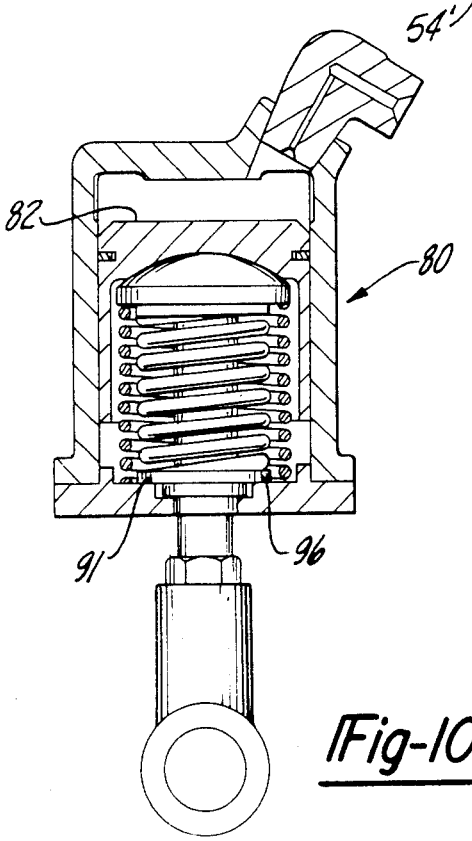

FIG. 10 is an illustration of the control piston and cylinder unit of FIG. 9 shown in engine mid-speed position.

Figure 11:
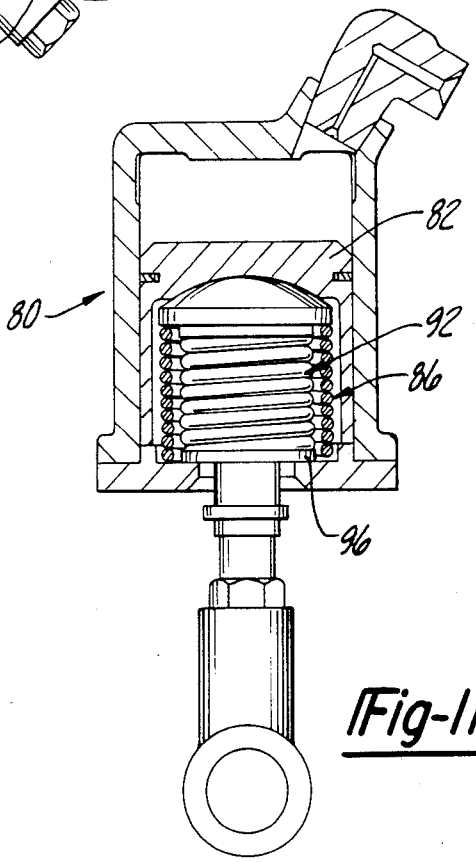

FIG. 11 is a view similar to FIG. 10 showing the piston in the engine high speed mode position.

Figure 1:
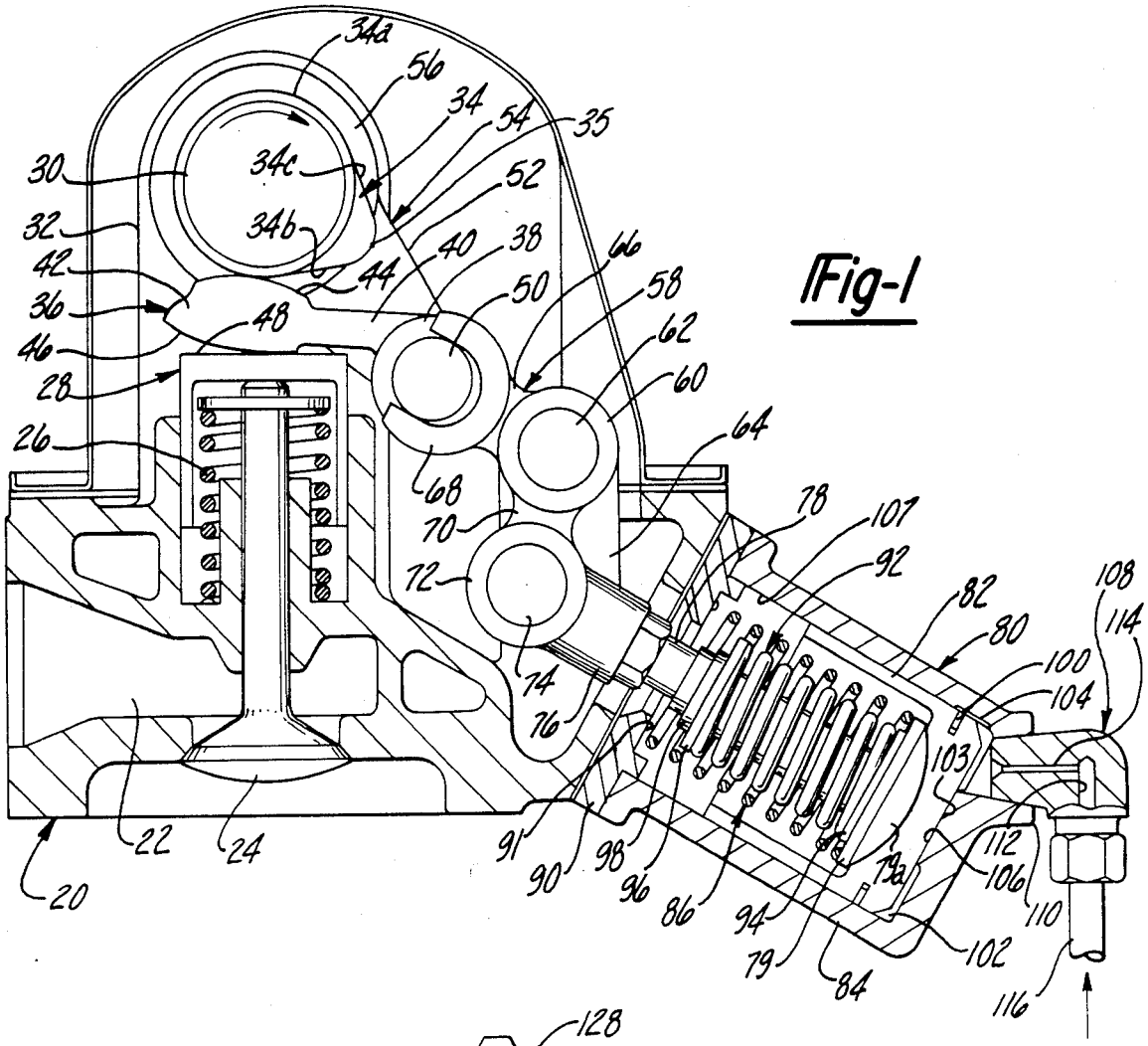
FIG. 1 is a vertical center sectional view through the cylinder head and associated overhead valve and overhead cam shaft of an automotive engine, taken in center section on one of the intake valves of the engine and equipped with a variable valve lift and timing mechanism of the present invention.

Referring in more detail to FIG. 1, an exemplary but preferred embodiment of one species of the invention is illustrated as applied to a conventional overhead valve, overhead cam shaft, four-stroke cycle, automotive-type engine of the multiple cylinder, in-line variety. The engine thus has a cylinder head 20 adapted to be bolted onto the usual cylinder block (not shown), and provided with a fuel/air intake passageway 22 leading to the usual intake poppet valve 24. Valve 24 is biased to closed position by the usual valve spring 26 disposed within the usual valve lifter 28. An overhad cam shaft 30 is assembled in journal 32 on the cylinder head and driven by gears, chain or other means from the engine crank shaft (not shown) in the usual fixed time relationship to the engine piston(s). In the illustrated example, rotation of the cam shaft 30 is in a clockwise direction, as indicated by the arrow in FIG. 1. Attached permanently to cam shaft 30 is a primary cam 34 fixed for rotation with cam shaft 30 and arranged one for each intake valve 24. Cam 34 has the usual functional fixed contour comprising a constant radius base 34*a*, rise and fall ramp faces 34*b* and 34*c* respectively and a nose radius 35 at the apex of the ramp faces. Cam 34 provides the actuating force to control the time of opening and closing of intake valve 24 as well as the amount of opening of the valve, as modified by the interposition of a variably oriented secondary cam 36 in accordance with the present invention.

Secondary cam 36 comprises a pivot collar portion 38, an arm 40 and a head 42 at its free end having a truncated elliptical form with a curved upper face 44 and a curved lower face 46. Upper face 44 slidably engages the base radius 34*a*, ramp faces 34*b* and 34*c* and nose 35 of primary cam 34, and lower face 46 slidably engages the upper surface 48 of lifter 28. Collar 38 of secondary cam 36 is journalled on a pivot shaft 50 which extends parallel to cam shaft 30 and is mounted in two or more pivot shaft brackets 54 (only one being shown) at points on camshaft 30 to provide adequate support for pivot shaft 50. Brackets 54 in turn each have a collar portion 56 journalled on cam shaft 30 adjacent the opposite ends of the cam shaft within the valve chamber. Pivot shaft 50 thus may be swung on brackets 54 in an arcuate path of travel concentric with the axis of cam shaft 30.

Pivot shaft 50 is actuated by a bell crank 58 having a collar 60 journalled on a fixed support shaft 62 mounted on a post 64 in the valve chamber. Bell crank 58 has an arm 66 with a clevice portion 68 at the free end thereof which slidably embraces pivot shaft 50. Crank 58 has another arm 70 with a pivot 72 at its end journalled on the pivot shaft arm 74 of a fitting 76 which is threadably received on the outer end of a piston rod 78 of a hydraulic control unit 80. The inner end of rod 78 has an integral head 79 with a spherical end surface 79*a* which slidably nests into a mating interior spherical seat 81 of a hydraulic piston 82. Piston 82 is in turn slidably received within a cylinder 84 of control unit 80. The spherical seating abutment of rod head 79 in seat 81 allows for freedom of alignment of rod 78 between piston 82 and pivot shaft arm 74. A primary coil compression spring 86 encircles rod 78 and abuts at one end against rod head 79, and abuts at its other end against mounting plate 90 of unit 80. A secondary coil compression spring 92 encircles rod 78 within spring 86 and abuts a platform 94 on head 79 of rod 78 and its other end abuts a washer 96 held fixed on rod 78 by a snap ring 98.

Piston 82 carries a sealing ring 100 adjacent its head end adapted to control leakage of hydraulic fluid from the hydraulic actuating chamber 102 of cylinder 84. When piston 82 is fully bottomed in cylinder 84 with its head end face 103 abutting the end face 106 of cylinder 84, ring 100 has moved into overlapping registry with an air bleed channel which communicates chamber 102 with the clearance space between piston 82 and the interior bore wall 107 of cylinder 84. An elbow fitting 108 is threadably secured in a boss 110 of cylinder 84 and has an oil feed passageway 112, with a reduced diameter restricted portion 114, communicating between chamber 102 and a hydraulic supply line 116 secured to fitting 108.

Figure 2:
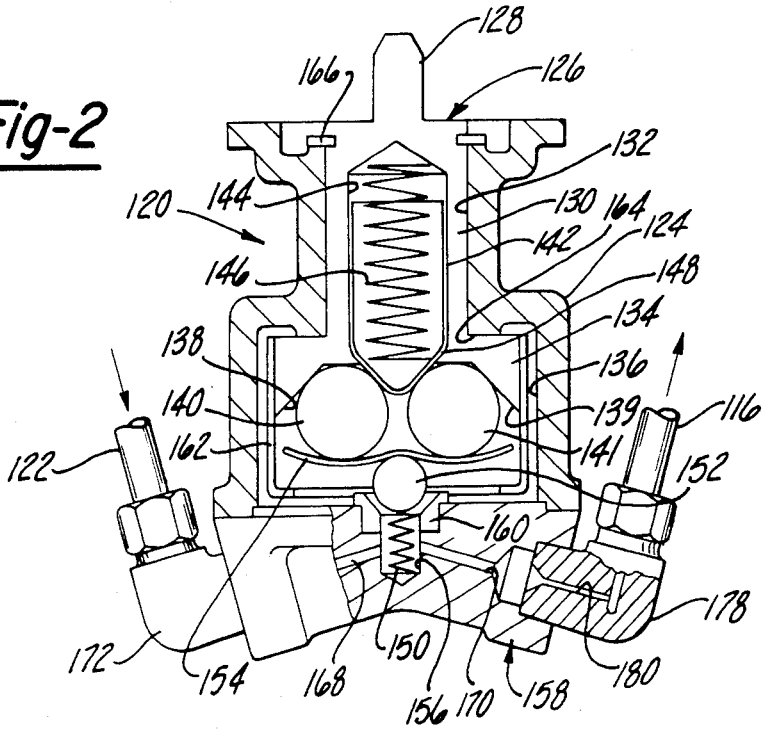
FIG. 2 is a vertical center sectional view through an engine-speed-responsive pressure regulating bypass control valve mechanism of the present invention.

Control unit 80 is hydraulically actuated by a suitable source of pressurized fluid, the pressure of which is correlated with the engine speed. As illustrated in FIG. 2, this is accomplished in accordance with another feature of the present invention by the provision of an engine-speed responsive pressure regulating bypass control valve mechanism 120 which is connected between supply line 116 and another supply line 122 connected to the outlet of the engine lubrication oil pump (not shown). Bypass valve 120 comprises a housing 124 in which is rotatably journalled a spinner shaft 126 with a protruding spindle 128 suitably coupled via a positive drive mechanism (not shown) to the engine crank shaft via the cam shaft drive train or other suitable hook up. Spinner 126 has a shaft portion 130 journalled in a bore 132 of housing 124 and a diametrically enlarged head portion 134 disposed for rotation in a bypass oil chamber 136 of housing 124. Head 134 has a plurality of ball races 138,139 sloping downwardly and outwardly as shown in FIG. 2 at a predetermined fixed angle, with spinner balls 140,141 individually received in each associated race. A centering plunger 142 is slidably received within a blind bore 144 of spinner 126 and has a coil compression spring 146 disposed interiorly of the plunger for lightly biasing the bulletshaped nose 148 of the plunger downwardly into light contact with the spinner balls 140,141. Plunger 142 thus operates to maintain the spinner balls 140,141 equi-distant from the rotational axis of spinner 126.

Spinner balls 140,141 are biased upwardly toward retracted position shown in FIG. 2 by an assemblage of a coil compression valve spring 150, a valve ball 152 and a support disc 154. Spring 150 is received in a blind bore 156 of a cover 158 fixed in sealed relation to the bottom end of housing 124. In the stationary and engine low speed mode of unit 120, spring 150 is operable to hold valve ball 152 off of a valve seat 160 mounted in cover 158. Ball 152 rides in a center concavity of disc 154. Disc 154 is curved upwardly near its outer perimeter so as to have a predetermined ramp curvature correlated with the geometrical function of the variation in centrifugal force acting on spinner balls 140 and 141 as they move radially relative to the spinner shaft axis in response to variations in the rotational speed of the spinner 126. The upward curvature of disc 154 is designed to provide an additional resistance to outward movement of the spinner balls so that, in conjunction with ramps 138 and 139 and the resistance of spring 150, the radial movement of the spinner balls represents more closely a linear function of engine speed.

To facilitate assembly, a cage cup 162 is press fit onto spinner head 134 after loose assembly of spring 146, plunger 142, balls 140,141 and disc 154 in head 134. The engagement of head 134 with an annular shoulder 164 of housing 124 and a snap ring 166 received in spinner shaft 130 hold spinner 136 fixed against axial movement relative to housing 124. Cover 158 has inlet and outlet passageways 168 and 170 communicating at their outer ends with fittings 172 and 178 respectively, and communicating at their inner ends with spring bore 156. Outlet fitting 178 has a restricted passageway 180 interposed between passageway 170 and conduit 116. Bypass chamber 136 of housing 124 is connected by a fitting (not shown) to a bypass return line (not shown) leading to the oil sump of the engine or to some other suitable point in the lubricating oil return path of the engine lubrication system.

In the operation of the embodiment of the invention as described thus far, the timing of opening and closing of intake valve 24 and the amount of lift or travel imparted to the valve between opening and closing is automatically varied in accordance with engine speed in the following manner. Assuming that the engine is stationary or has been started and is operating at some predetermined idle speed condition, engine lubrication oil pressure will be at some value between zero and a minimum psi value depending upon the parameters of the given engine to which the invention is applied. Under these conditions, the spinner shaft 126 is stationary or rotating at a low rpm and hence the centrifugal force acting upon balls 140,141 is insufficient to overcome the pressure of the spring 150 and the oil pressure existing in passages 168,170. Thus, by-pass valve 152 resides in an open condition essentially as illustrated in FIG. 2, and lubricating oil is by-passed with a minimum pressure drop from feed line 122 via valve 152-160 into chamber 136 and thence back to the engine oil sump. Accordingly, oil pressure in the working chamber 102 in the unit 80 is insufficient to force piston 82 out of the fully bottomed position shown in FIG. 1. Therefore, secondary cam 36 is oriented to pivot about the axis of shaft 50 with shaft 50 maintained by the bell crank 58 in the stationary or low speed mode illustrated in FIG. 1. Note that this position of the bell crank and shaft 50 corresponds to that shown in FIGS. 5 and 6 wherein the parts are illustrated inverted from that shown in FIG. 1.

With the engine running up to the aforementioned idle speed, rotation of cam shaft 30 and associated primary cam 34 will transmit a reciprocating movement via the secondary (or intermediate) cam 36 and follower 28 to valve 24. FIG. 6 illustrates the approach of the ramp **34*b* of cam 34 into engagement with secondary cam head 42, and FIG. 5 illustrates engagement of the nose 35 of primary cam 34 with secondary cam head 42. This advances, via lifter 28, the valve 24 to its full open position, the valve timing being in a retarded position relative to the rotational position of the cam shaft. For such retarded timing, the points of opening and closing of intake valve 24 and its maximum lift and travel relative to rotation of the crank shaft for this engine stationary or low speed mode are illustrated in one example by the curve labeled "FIG. 5" in the graph of FIG. 7. Note that secondary cam 36 is oscillated by entrapment between primary cam 34 and follower 28 about the axis of shaft 50 as a pivot and fulcrum point, and cam 36 pivots between the extreme positions shown in FIGS. 5 and 6 in such low speed mode. Note also that at the point of maximum lift shown in FIG. 5, the engagement point 100 of the nose 35 of cam 34 is spaced by a moment arm A from the axis of shaft 50, which is a distance less than the moment arm spacing B of the point of engagement 102 of face 46 with follower 28. Referring to FIG. 6, the respective engagement points of faces 46 and 44 with follower 28 and cam 34 respectively are indicated by the reference numeral 102' and 100'. It will be seen from FIGS. 5 and 6 that moment arm A remains relatively constant throughout rotation of cam 34 and pivotal movement of cam 36, whereas in engine low speed mode moment arm B varies between the limits shown in FIGS. 5 and 6. Thus, moment arm B is greater than moment arm A at full open position (maximum lift) of valve 24 when the engine is in low speed range, and moment arm B is less than moment arm A at valve 24 closing when face 44 of cam 36 is against base radius 34***a* of cam 34. Hence, in low speed mode cam 36 operates sequentially as a lever of the second class and third class with the axis of shaft 50 being the fulcrum point. During contact of the root base 34*a* of cam 34 with face 44 of cam 36, moment arm A is greater than moment arm B and hence cam 36 operates as as a second class lever. As the ramp rise side 34*b* of cam 34 comes into contact with face 44, cam 36 first operates a lever of the second class in a force multiplying mode of decreasing leverage. As cam face 44 approaches the full lift position of FIG. 5, the force moment arm A becomes less than the transmission moment arm B, thereby converting cam 36 to a lever of the third class so as to be operable in a distance multiplying mode. In this distance multiplying mode, the leverage of the interposed secondary cam 36 imposes only a slighter greater lift of follower 28 than the actual full lift over the nose 35 of cam 34. Moreover, the points of openings and closing of intake valve 24, as seen in the "FIG. 5" curve of FIG. 7, occur at predetermined spaced points relative to crank shaft rotation such that the time of opening and closing are both retarded in a predetermined manner.

Referring again to FIG. 2, as engine speed increases from idle to a preselected midpoint rpm range, the corresponding build-up in engine lubrication oil pressure from the output of the engine lubrication pump, combined with the increase in rotational speed of spinner 126, tending to force ball 152 toward its seat 160, will produce an increase in the oil pressure in chamber 102. This, in turn, will force piston 82 on its working stroke (away from cylinder endface 106) against the yieldable biasing force exerted by spring 86 until washer 96 abuts the face 91 of plate 90. This first stage motion of piston 82 is illustrated by the change of position of piston 82 from that shown in FIG. 9 to that shown in FIG. 10. The corresponding movement of piston rod 76 will rotate ball crank 58 in a clockwise direction as viewed in FIG. 1, thereby pivoting shaft 50 counter-clockwise about the axis of cam shaft 30. This change in position of the fulcrum point of secondary cam 36 is effective to advance the opening and closing of the intake valve 24 as well as to impart a greater amount of lift to the same. In the engine mid-speed range, the timing and lift parameters thereafter remain constant as engine speed is further increased through a predetermined engine mid-speed range because of the action of the two-stage biasing springs 86 and 92 of control unit 80. This occurs upon washer 96 bottoming against plate surface 91 as shown in FIG. 10, whereupon secondary spring 92 comes into play and further outward motion during the working stroke of piston 82 is resisted by the return biasing force of both springs 86 and 92.

As engine speed further increases beyond the upper limit of the pre-selected mid-speed range, the centrigual forces acting on governor balls 140,141 will be sufficient to drive them further outwardly and downwardly along ramps 138,139 so as to finally force check ball 152 closed upon its seat 160. This action shuts off the oil by-pass while engine oil pump output pressure is reaching its maximum value. The oil pressure in line 116 and in chamber 102 thus rises through a third range which is sufficient to compress both springs 92 and 86 and thus drive piston 82 from its mid-point position shown in FIG. 10 to its fully actuated position shown in FIG. 11 wherein both springs 86 and 92 have been bottomed. This second increment of travel of piston rod 76 produces further clockwise pivoting of bell crank 58 and thus further counter-clockwise pivoting of shaft 50 about the axis of cam shaft 30, whereby shaft 50 is translated to the advanced-high engine speed position of FIGS. 3 and 4. In this engine high speed mode, secondary cam 36 pivots about a further translated fulcrum point wherein, as indicated in FIGS. 3 and 4, the force application moment arm A is relatively constant and always less than the force transmission moment arm B. Hence, cam 36 in the high speed mode is always operative as a third class lever in a distance multiplying mode so that the travel of lifter 28 is always greater than the lift or rise of nose 35 of cam 34. In this mode, the opening and closing points of intake valve 24 are both advanced relative to the aforementioned retarded-engine low-speed mode, and the amount of lift is also increased by a predetermined amount over the retarded mode. This may be seen in FIG. 7 by comparing the retarded-low engine speed curve labeled "FIG. 5" with the advanced-high engine speed curve labeled "FIG. 3". Of course, as engine speed decreases from maximum through mid-speed range and back to idle, the reverse sequence occurs.

It will be noted that momentary or transient engine speed changes are not converted into valve timing and lift changes because of the isolation between sudden engine oil pressure changes and control system actuation produced by the restricted passage 114 (FIG. 1) and 180 (FIG. 2) in fittings 108 and 178 respectively. Hence, valve timing and lift are maintained generally in phase with engine speed and load conditions while the vehicle is traveling along a road. In addition, the restricted passages 114 and 180 are also dimensioned to control the flow of oil into and out of the control cylinder chamber 102 so as to dampen out pulses generated by the primary cam 34 against the secondary cam 36 and reflected back through the shaft 50 to piston rod 76.

In addition to the variation in valve lift and timing produced by varying the position of the fulcrum shaft 50 for the secondary cam 36 so as to vary its mode of operation as a lever, the present invention also contemplates increasing or decreasing the valve lift in relationship to the primary cam 34 by varying the shape and/or orientation of the elliptical-type head 42. As illustrated in FIG. 8, head 42 is shown schematically by the solid line elliptical body 42' having a major axis 42*a* and a minor axis 42*b*. In FIG. 8, the phantom line showing of head 42' illustrates the major axis tilted through an angle T with the position labeled as 42''. Note how such tilting of head 42' to the position 42'' prys follower 28 from the phantom position 28' upward to the position of follower 28 shown in solid lines. This can be effected by the aforementioned shifting of the fulcrum pivot 50 for the secondary cam 36. Further variations can be effected by modifying the elliptical from of head 42 as well as by changing the permanent relationship or angle of the major axis 42*a* relative to the arm 40 and collar 38 of secondary cam 36. Hence, the leverage ratio and leverage mode transition may be readily varied by the designer to provide the desired automatic shift and valve timing and lift pursuant to the objects of the present invention.

As illustrated in the modified embodiment of FIG. 9, the valve lift and timing mechanism of the engine is also readily applicable to a V-type engine. In FIG. 9, the control unit 80 is the same as previously described and the same reference numerals applied, and like numbers raised by a prime suffix are applied to elements corresponding to those previously described. However, instead of actuating pivot shaft 50 through a bell crank as in the embodiment of FIG. 1, piston rod 76 is directly connected to the associated collar (not shown) on shaft 50, and head 79 of rod 76 is swivel articulated to piston 82 as described previously. The support bracket 54' with its associated arms 52', which carry shaft 50, is again journalled by collars 56' on the main cam shaft 30'. In this embodiment, bracket 54' has a further pair of arms 52'' oriented at 90° to arms 52' and which support a second pivot shaft 50' extending parallel to shaft 50. A second set of secondary cams 36', identical to the secondary cams 36 carried on shaft 50 are pivotally carried on shaft 50'. The first set of secondary cams 36 are individually interposed between an associated primary cam 34 and an associated lifter 28 for one bank of cylinders, and likewise the second set of secondary cams 36' are interposed individually between the associated primary cam 34 and lifters 28' for the other bank of cylinders. It will be seen that with this modification the lift and timing of the intake valves of a V-type engine can be varied and controlled in the same manner as that described in conjunction with the embodiment of FIG. 1.

From the foregoing description, it will now be apparent that the variable valve lift and timing mechanism of the present invention readily fulfills the aforementioned objects and provides several advantageous features over the prior art. With this mechanism, the designer can set the valve timing and lift for high speed engine operation at optimum values to achieve the greatest compression pressure in the combustion chamber at which the engine will operate smoothly without roughness or detonation. The automatic retardation of the valve timing and reduction of the valve lift is then correlated with decreasing engine speed so as to prevent excessive compression and combustion pressures in the combustion chambers of the engine. Thus, when applied to an existing engine, the invention provides a simple and reliable means of reducing the effective volume of the cylinder or cylinders at low engine speeds so that the geometric volume of the combustion chamber likewise can be reduced without increasing the effective combustion pressure in the combustion chamber beyond the tolerance of the engine. Savings in engine size and weight without a decrease in engine performance and efficiency thus become achievable when the engine is equipped with the variable valve lift and timing mechanism of the present invention.

It is also to be noted that the invention advances the time of closing of the intake valve as well as the time of its opening which, in turn, increases the cut-off volume of the engine cylinder as engine speed increases to compensate for the decrease in effective engine cylinder volume resulting from the increase in piston velocity with increasing engine speed. The invention also minimizes transmission of reaction forces back to the secondary cam support structure, most of the reaction load being taken directly by the engine cam shaft due to the secondary cams being bracket-supported on the main cam shaft.

The associated control mechanism of the invention also is advantageous in providing three basic engine speed positions, a low speed position for engine idle conditions, a mid-speed setting for engine mid-range speeds, and a high speed mode for engine cruising conditions, with a gradual and smooth transition therebetween. The pivotal support of the secondary cam pivot shaft 50 and the elliptical-type shape of the head 42 of secondary cam 36 is operable to permit shift in valve timing and lift in a smooth manner at any point in the rotation of the primary cam 34 without damage and undue stress on the mechanism. Moreover, the invention is directly applicable to existing primary intake cams without requiring any change in the width of the same, and likewise will fit existing conventional engine valve and cylinder spacing. Regardless of the type of engine, only one control unit is required to vary the valve lift and timing. Due to the pivot shaft bracket 52, the pivot shaft 50 and the associated secondary cams 36 all being rotated around the cam shaft 30 as a unit, and due to the elliptical form of the secondary cam head 42, uniform valve clearance is obtained at all valve timing positions and no change is required in the usual flat face 48 of lifter 28 or in the conventional fixed profile of the primary cam 34.

I claim:

1. In an internal combustion engine having at least a cylinder and a piston defining a variable volume combustion chamber, a poppet-type valve for said combustion chamber operated by a valve spring and associated valve lifter, a cam shaft and fixed profile primary cam thereon providing a fixed timing mode of operation for said valve, the improvement comprising a variable valve lift and timing mechanism including a secondary cam having a head at a free end thereof operably interposed between and slidably contacting said primary cam and said lifter, means for pivotally supporting said secondary cam at an end thereof remote from said free end for pivotal movement of said secondary cam about a fulcrum point spaced from the contact points of said primary cam and lifter with said secondary cam and control means operable to vary the position of said fulcrum point as a function of the speed of the engine to thereby vary the amount of lift and the timing of the opening and closing of said valve, while maintaining the period between said opening and closing generally constant, said secondary cam head being non-circular and having first and second convexly curved surfaces slidably bearing against said primary cam and said lifter respectively.

2. The combination as set forth in claim 1 wherein said support means comprises a pivot shaft and associated bracket means therefor carried on said cam shaft for movement of the pivot shaft in an arc concentric with the axis of said cam shaft.

3. The combination set forth in claim 2 wherein said secondary cam control means comprises a hydraulic cylinder housing an actuating piston mechanically linked to said fulcrum support means for controlling the movement of the same, the working chamber of said hydraulic cylinder being in operative communication with a source of engine lubrication pressurized oil having an output pressure correlated with engine speed whereby valve timing is advanced and valve lift increased with an increase in engine speed and vice versa.

4. The combination as set forth in claim 3 wherein said control unit piston is biased to a low speed position by a pair of first and second coil compression springs, said first spring being operable to yieldably bias the control piston between a low speed and a mid speed position, said second spring being operable to yieldably bias said piston between the mid-speed and a high speed position in conjunction with the continued biasing force exerted by the first spring to thereby provide a constant mid-speed position of said secondary cam while engine speed varies between a predetermined minimum and maximum value defining an engine mid-speed rpm range.

5. The combination as set forth in claim 3 wherein said control means includes a pressure regulating by-pass valve means operably coupled between said engine oil source and said control unit for varying the pressure of the lubrication oil supplied to said control unit in a direct relationship with engine speed.

6. The combination as set forth in claim 5 wherein said by-pass valve means includes a by-pass valve ball and associated spring tending to bias said valve ball toward open position, and a speed-responsive centrifugally actuated mechanism acting on said by-pass valve ball in opposition to said spring so as to force said by-pass valve ball toward closed position with an increase in engine speed.

7. The combination as set forth in claim 6 wherein said control means includes restricted passage means communicating with an outlet of said by-pass valve means and an inlet to said control unit cylinder so as to dampen pressure pulsations imparted to said control piston by engine valve operation and to moderate sudden changes in engine oil pressure imparted via said by-pass valve means to said control unit.

8. The combination set forth in claim 3 wherein said hydraulic cylinder has a restricted by-pass air bleed groove therein communicating the working chamber of said hydraulic cylinder with a sliding clearance space between said hydraulic cylinder and said actuating piston only in a low speed position of said actuating piston, said clearance space being in constant communication with an engine oil return path to said engine oil source.

9. The combination as set forth in claim 1 wherein said engine is of the V-type having at least a pair of said cylinders and associated pistons oriented in V-relationship to one another, said valve and associated valve spring and lifter being provided one for each of said cylinders with said cam shaft being common thereto, each of said valves having an associated one of said lifters operably associated with said cam shaft, said secondary cam being interposed between the lifter for one of said cylinders and the associated primary cam, and a second secondary cam identical to said first mentioned secondary cam interposed between said primary cam and said lifter for said other cylinder, and second fulcrum means for said second secondary cam operably linked for unitary movement with said first-mentioned fulcrum support means.

10. The combination as set forth in claim 9 wherein said second fulcrum means comprises a pivot shaft and associated support means also mounted on said cam shaft and connected to said first pivot shaft for movement in an arc concentric with the axis of said cam shaft.

11. In an internal combustion engine having at least a cylinder and a piston defining a variable volume combustion chamber, a valve train including a poppet-type valve for said combustion chamber and an associated valve lifter, a rotatable cam shaft and fixed profile primary cam having a base circle and cam lobe thereon providing a fixed timing mode of operation for said valve, the improvement comprising a variable valve lift and timing mechanism including a secondary cam having a head at a free end thereof operably interposed as a variable lever in said valve train between and slidably contacting said primary cam and said lifter, said secondary cam head having first and second curved surfaces slidably bearing respectively against said primary cam and said lifter and extending generally in the direction of the major axis of said head, means for supporting said secondary cam at an end thereof remote from said free end for movement of said secondary cam through a given path in a plane perpendicular to the rotational axis of said cam shaft, and control means coupled to said secondary cam support means and operable to vary the position of said secondary cam so as to tilt the major axis of said secondary cam head to thereby vary the leverage thereof as a function of the speed of the engine to thereby vary the amount of lift and the timing of the opening and closing of said valve, said first and second secondary cam head surfaces being shaped so as to cooperate with their respective slidable engagement with said primary cam and said lifter to maintain the length of said valve train constant when said secondary cam head is is riding on the base circle of said primary cam throughout the movement in said given path of said secondary cam.

12. The combination as set forth in claim 11 wherein said path of movement of said secondary cam includes a component operable to shift said secondary cam head transversely of the direction of travel of said valve lifter as well as a component parallel to the direction of travel of said lifter which produces said tilting of said secondary cam head major axis.

13. The combination set forth in claim 11 wherein said first and second surfaces of said secondary cam head comprise opposed convex surfaces each having a profile cooperable with said lifter and primary cam to produce an initial gradual acceleration of said lifter and valve following the instant of valve opening and a final gradual deceleration of said lifter and valve as said valve closes.

14. The combination set forth in claim 11 wherein said primary cam and said secondary cam head surfaces are profiled to cooperate with said path of movement of said secondary cam to maintain the period between the instant of opening and the instant of closing of said valve, relative to piston position, generally constant.

15. In an internal combustion engine having at least a cylinder and a piston defining a variable volume combustion chamber, a poppet-type valve for said combustion chamber operated by a valve spring and associated valve lifter, a cam shaft and fixed profile primary cam thereon providing a fixed timing mode of operation for said valve, the improvement comprising a variable valve lift and timing mechanism including a secondary cam having a head at a free end thereof operably interposed between and slidably contacting said primary cam and said lifter, means for pivotally supporting said secondary cam at an end thereof remote from said free end for pivotal movement of said secondary cam about a fulcrum point spaced from the contact points of said primary cam and lifter with said secondary cam and control means operable to vary the position of said fulcrum point as a function of the speed of the engine to thereby vary the amount of lift and the timing of the opening and closing of said valve, said secondary cam control means comprising a hydraulic cylinder housing an actuating piston mechanically linked to said fulcrum support means for controlling the movement of the same, the working chamber of said hydraulic cylinder being in operative communication with a source of engine lubrication pressurized oil having an output pressure correlated with engine speed whereby valve timing is advanced and valve lift increased with an increase in engine speed and vice versa, said control means including a pressure regulating by-pass valve means operably coupled between said engine oil source and said control unit for varying the pressure of the lubrication oil supplied to said control unit in a direct relationship with engine speed, said by-pass valve means including a by-pass valve ball and associated spring tending to bias said valve ball toward open position, and a speed-responsive centrifugally actuated mechanism acting on said by-pass valve ball in opposition to said spring so as to force said by-pass valve ball toward closed position with an increase in engine speed.

16. The combination as set forth in claim 15 wherein said control means includes restricted passage means communicating with an outlet of said by-pass valve means and an inlet to said control unit cylinder so as to dampen pressure pulsations imparted to said control piston by engine valve operation and to moderate sudden changes in engine oil pressure imparted via said by-pass valve means to said control unit.

17. In an internal combustion engine having at least a cylinder and a piston defining a variable volume combustion chamber, a poppet-type valve for said combustion chamber operated by a valve spring and associated valve lifter, a cam shaft and fixed profile primary cam thereon providing a fixed timing mode of operation for said valve, the improvement comprising a variable valve lift and timing mechanism including a secondary cam having a head at a free end thereof operably interposed between and slidably contacting said primary cam and said lifter, means for pivotally supporting said secondary cam at an end thereof remote from said free end for pivotal movement of said secondary cam about a fulcrum point spaced from the contact points of said primary cam and lifter with said secondary cam and control means operable to vary the position of said fulcrum point as a function of the speed of the engine to thereby vary the amount of lift and the timing of the opening and closing of said valve, said secondary cam control means comprising a hydraulic cylinder housing and actuating piston mechanically linked to said fulcrum support means for controlling the movement of the same, the working chamber of said hydraulic cylinder being in operative communication with a source of engine lubrication pressurized oil having an output pressure correlated with engine speed whereby valve timing is advanced and valve lift increased with an increase in engine speed and vice versa, said control unit piston being biased to a low speed position by a pair of first and second coil compression springs, said first spring being operable to yieldably bias the control piston between a low speed and a mid-speed position, said second spring being operable to yieldably bias said piston between the mid-speed and a high speed position in conjunction with the continued biasing force exerted by the first spring to thereby provide a constant mid-speed position of said secondary cam while engine speed varies between a predetermined minimum and maximum value defining an engine mid-speed rpm range.

18. In an internal combustion engine having at least a cylinder and a piston defining a variable volume combustion chamber, a poppet-type valve for said combustion chamber operated by a valve spring and associated valve lifter, a cam shaft and fixed profile primary cam thereon providing a fixed timing mode of operation for said valve, the improvement comprising a variable valve lift and timing mechanism including a secondary cam having a head at a free end thereof operably interposed between and slidably contacting said primary cam and said lifter, means for pivotally supporting said secondary cam at an end thereof remote from said free end for pivotal movement of said secondary cam about a fulcrum point spaced from the contact points of said primary cam and lifter with said secondary cam and control means operable to vary the position of said fulcrum point as a function of the speed of the engine to thereby vary the amount of lift and the timing of the opening and closing of said valve, said secondary cam control means comprising a hydraulic cylinder housing an actuating piston mechanically linked to said fulcrum support means for controlling the movement of the same, the working chamber of said hydraulic cylinder being in operative communication with a source of engine lubrication pressurized oil having an output pressure correlated with engine speed whereby valve timing is advanced and valve lift increased with an increase in engine speed and vice versa, said hydraulic cylinder having a restricted by-pass air bleed groove therein communicating the working chamber of said hydraulic cylinder with a sliding clearance space between said hydraulic cylinder and said actuating piston only in a low speed position of said actuating piston, said clearance space being in constant communication with an engine oil return path to said engine oil source.

* * * * *